US007367479B2

(12) United States Patent
Sitz

(10) Patent No.: US 7,367,479 B2
(45) Date of Patent: May 6, 2008

(54) DEVICE TO RETAIN CARBONATION

(76) Inventor: William G. Sitz, 4031 Lakota Pl., Kingsport, TN (US) 37664

( * ) Notice: Subject to any disclaimer, the term of this patent is extended or adjusted under 35 U.S.C. 154(b) by 455 days.

(21) Appl. No.: 11/059,518

(22) Filed: Feb. 17, 2005

(65) Prior Publication Data

US 2005/0199652 A1 Sep. 15, 2005

Related U.S. Application Data

(60) Provisional application No. 60/551,786, filed on Mar. 11, 2004.

(51) Int. Cl.
*B65D 83/00* (2006.01)

(52) U.S. Cl. ..... 222/400.7

(58) Field of Classification Search ..... 222/400.7, 222/389, 386.5, 95, 105; 141/25–27, 315
See application file for complete search history.

(56) References Cited

U.S. PATENT DOCUMENTS 2,326,641 A * 8/1943 Heeter et al. ..... 222/518
4,854,483 A 8/1989 Haggart
4,984,717 A * 1/1991 Burton ..... 222/183
5,499,758 A 3/1996 McCann et al.
5,667,110 A 9/1997 McCann et al.
6,073,811 A * 6/2000 Costea ..... 222/400.7
6,502,725 B1 1/2003 Alexander
6,796,462 B2 * 9/2004 Hudson et al. ..... 222/543
7,114,634 B2 * 10/2006 Azodi ..... 222/400.7
2003/0102333 A1 6/2003 Wright

FOREIGN PATENT DOCUMENTS

GB 2 220 408 A 1/1990
JP 04018297 A * 1/1992 ..... 222/400.7

* cited by examiner

*Primary Examiner*—Philippe Derakshani
(74) *Attorney, Agent, or Firm*—Richard C. Litman

(57) ABSTRACT

A device that allows a user to retain carbonation in conventional plastic beverage bottles for extended periods of time. In a first embodiment, a fluid impermeable, inflatable, elastic bladder is employed to fill the vapor space in the bottle when the beverage is dispensed. With the vapor space filled, the $CO_2$ carbonization gases cannot dissipate. The bladder is removably attached to a nozzle cap. The nozzle cap incorporates an arrangement including an inflating tube that permits a user to inflate the bladder by simply blowing into the inflation tube.

1 Claim, 5 Drawing Sheets

DEVICE TO RETAIN CARBONATION

CROSS-REFERENCE TO RELATED APPLICATION

This application claims the benefit of U.S. Provisional Patent Application Ser. No. 60/551,786, filed Mar. 11, 2004.

BACKGROUND OF THE INVENTION

1. Field of the Invention

The present invention generally relates to fluid dispensers. More specifically, the present invention is drawn to a device for retaining carbonization of carbonated beverages.

2. Description of the Related Art

Because of convenience and cost, carbonated beverages are now mostly sold in plastic bottles instead of the glass containers that were used in the past. The plastic bottles are light in weight and unbreakable. However, when the consumer attempts to store the beverage over a period of time after partial use, the beverage loses its carbonation and the consumer is left with a flat, tasteless drink that is often discarded. This scenario results in a loss of not only a refreshing drink but also a loss of money. Retail establishments utilize re-carbonization systems to maintain the palatability of their beverages. To employ such systems in the home, however, would involve a relatively costly endeavor. A simplistic, inexpensive, device for maintaining carbonization in a two or more liter plastic bottle would certainly be a welcome addition to the marketplace.

The related art is awash with devices designed to maintain carbonization in fluids and to assist in dispensing the fluids. Examples of such devices are cited and identified in the accompanying IDS. However, none of the above inventions and patents, taken either singly or in combination, is seen to disclose a device for retaining carbonization as will be subsequently described and claimed in the instant invention.

SUMMARY OF THE INVENTION

The device of the instant invention allows a user to retain carbonation in conventional plastic beverage bottles for extended periods of time. In a preferred embodiment, a fluid impermeable, inflatable, elastic bladder is employed to fill the vapor space in the bottle once a portion of the beverage is dispensed. With the vapor space filled, the $CO_2$ carbonization gases cannot dissipate. The bladder is removably attached to a nozzle cap. The nozzle cap incorporates a simplistic arrangement including an inflating tube that permits a user to inflate the bladder by blowing into the inflation tube. Accordingly, the invention presents a simplistic device for retaining carbonization, which device is adaptable for use with conventional, plastic beverage containers. Devoid of moving parts, the device is easy to maintain and use. Improved elements and arrangements thereof are provided for the purposes described which are inexpensive, dependable and fully effective in accomplishing their intended purposes.

The present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
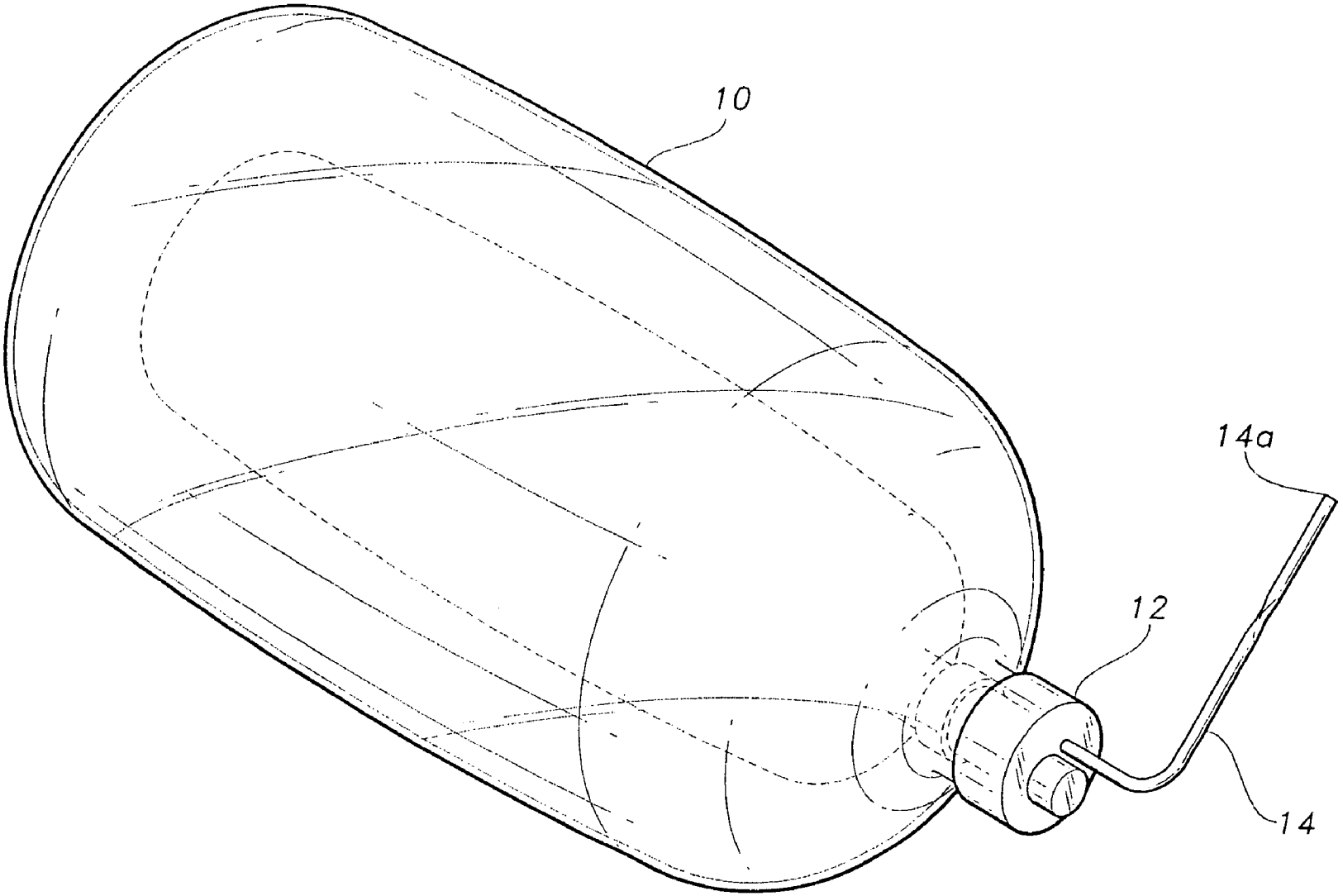
FIG. 1 is an environmental, perspective view of a first embodiment of a device to retain carbonation according to the present invention.

Attention is first directed to FIG. 1 wherein a plastic beverage container is indicated at 10. Container 10 is fabricated from conventional plastic material e.g. polyethylene terephthalate and is generally at least two liters in volume. A nozzle 12 is secured to the top of bottle 10. An inflating tube 14, whose function is explained below, extends from nozzle 12 and has a distal end 14*a* open to ambient atmosphere.

Figure 2:
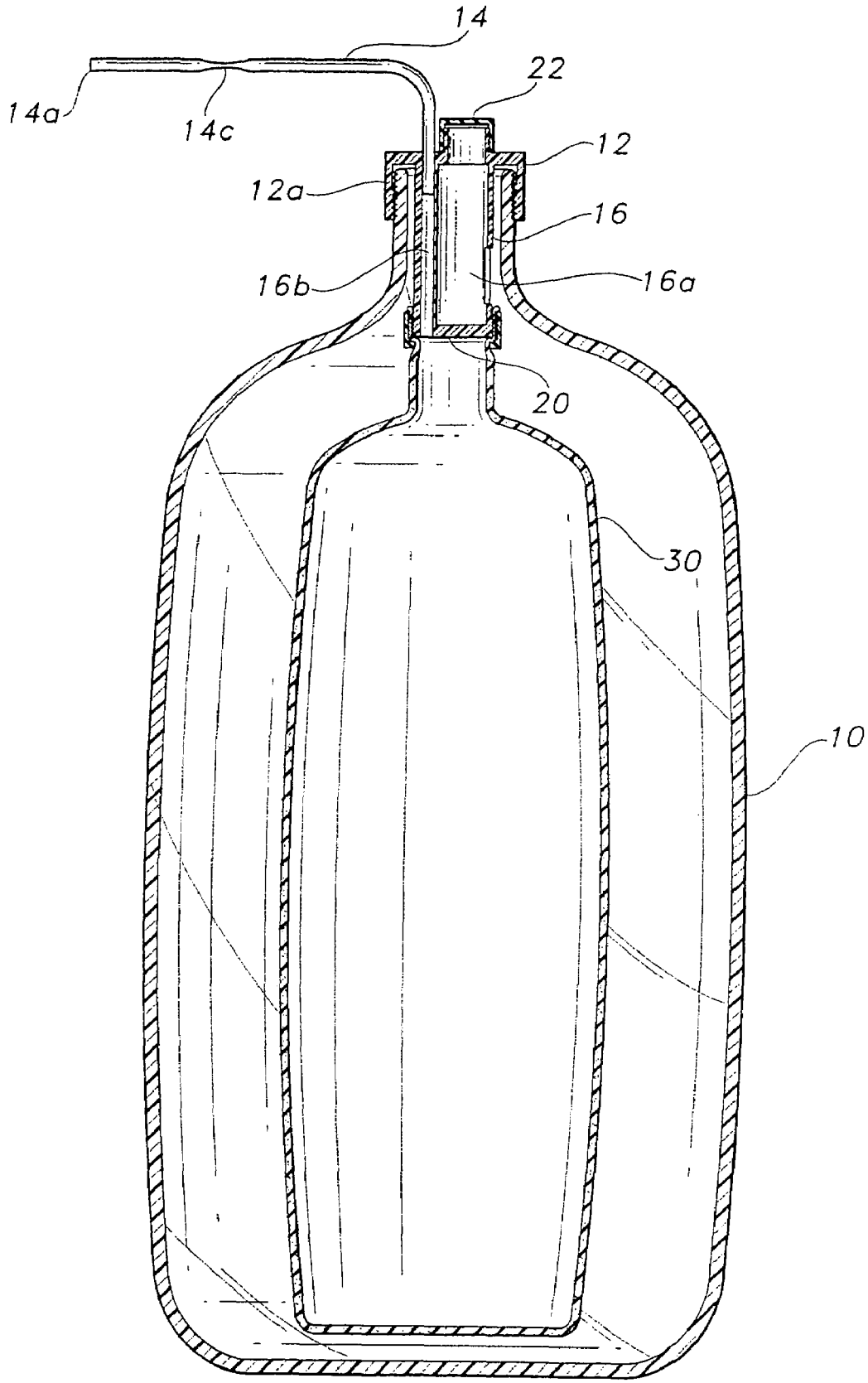
FIG. 2 is a cross-sectional view of a first embodiment of a device to retain carbonization according to the present invention.
Figure 3:
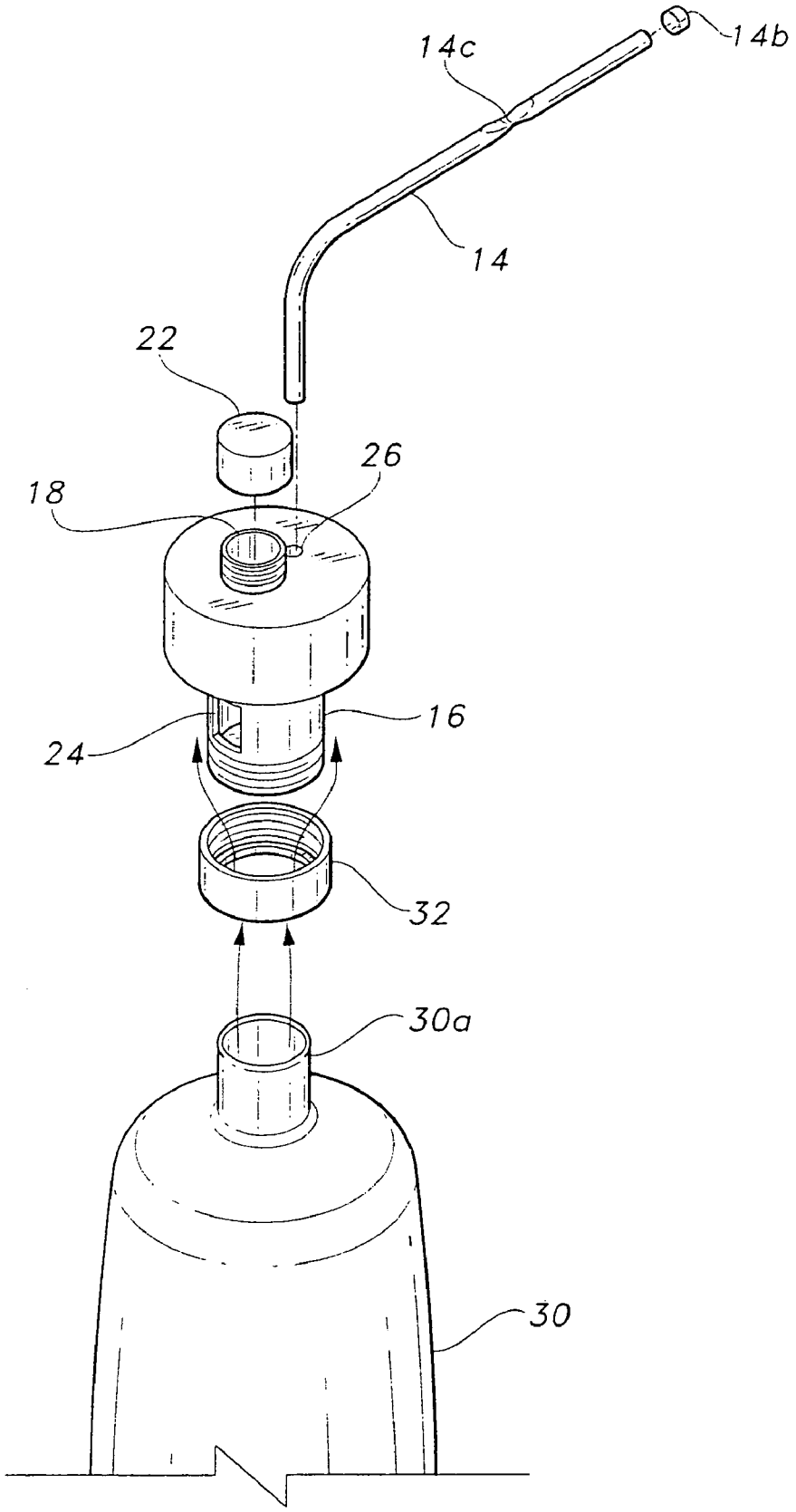
FIG. 3 is a partial, exploded view of a first embodiment of a device to retain carbonization according to the present invention.
Figure 4:
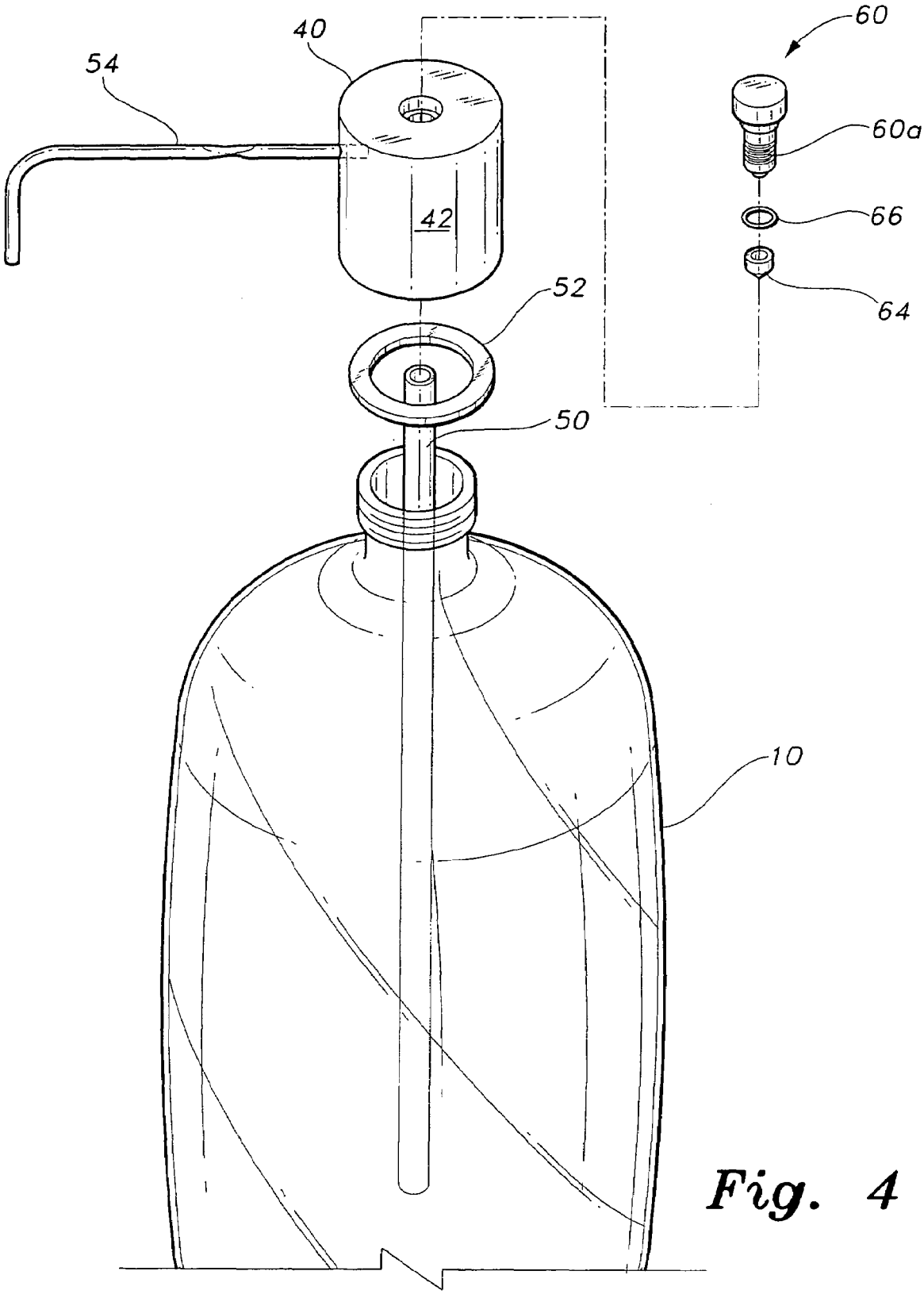
FIG. 4 is an exploded, perspective view of a second embodiment of a device to retain carbonation according to the present invention.
Figure 5:
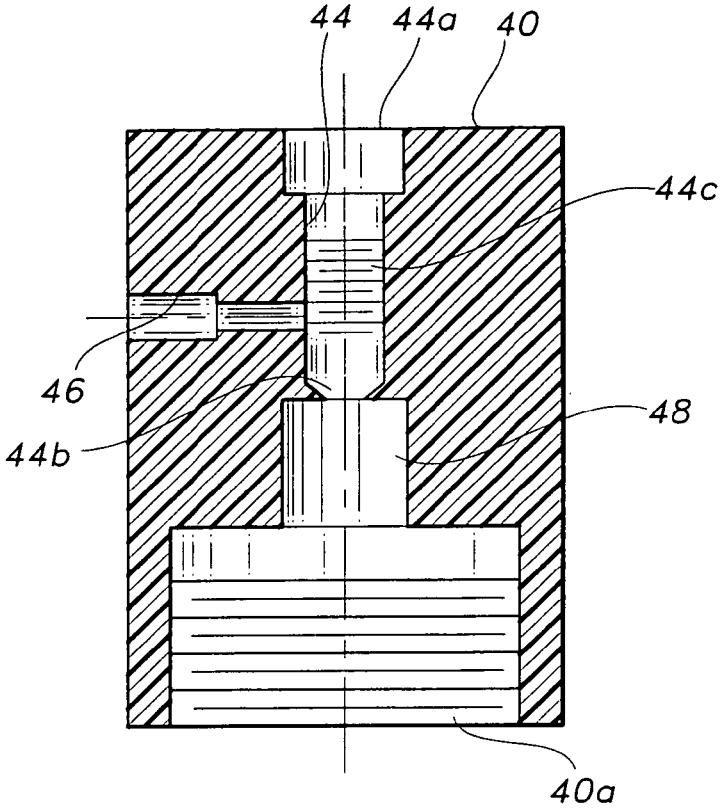
FIG. 5 is a cross-sectional view of a cap for a second embodiment of a device to retain carbonation according to the present invention.
Figure 6:
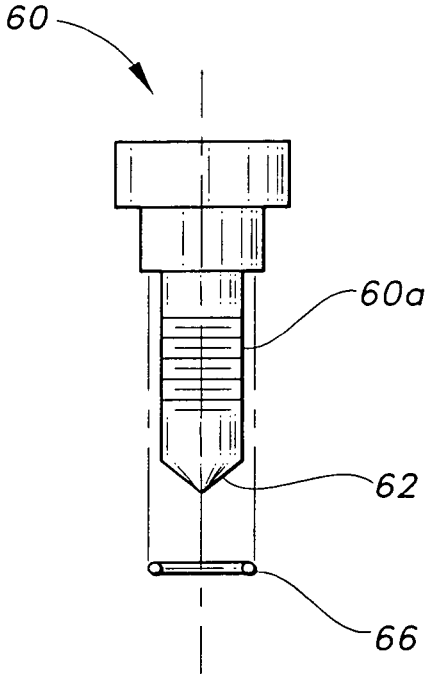
FIG. 6 is a plan view of a needle valve for a second embodiment of a device to retain carbonation according to the present invention.

As best seen in FIGS. 2 and 3, nozzle 12 includes a cap having internal threads 12*a* whereby the nozzle can be removably threaded on bottle 10. A short cylindrical member 16 depends from an interior face of the cap. Member 16 is partitioned so as to encompass two volumetric spaces 16*a* and 16*b*. Space 16*a* is open at its upper end 18 and closed at its lower end 20. A removable closure 22 is adapted to optionally seal and unseal end 18. An opening 24 is formed in the wall of member 16. Space 16*b* is open through the cap at 26 and is also open at its lower end. A bladder 30 fabricated from a fluid impermeable, stretchable material is positioned inside bottle 10. Bladder 30 is provided with a neck portion 30*a*. When assembled, neck portion 30*a* is secured to lower end 20 with nut 32. Opening 24 communicates with the interior of bottle 10. Chamber 16*b* is sized to tightly receive the proximate end of tube 14 via opening 26.

To operate, closure 22 and cap 14*b* are respectively removed from nozzle 12 and tube 14. Bladder 30 may then be inflated by blowing (or pumping) air into the end 14*a* of tube 14. As bladder 30 inflates, most of the air in the upper regions of bottle 10 will be pushed out through opening 24. Tube 14 can be pinched at 14*c* between breaths to prevent the air used to inflate the bladder from escaping back out of the tube. When bladder 30 is sufficiently inflated, cap 14*b* and closure 22 are re-secured, thus sealing bottle 10 until ready for further use.

FIGS. 4-7 illustrate a second embodiment of the invention that does not require a bladder. A cap 40 is provided with an external grip surface 42 and internal threads 40*a* whereby cap 40 may be removably secured to bottle 10. Cap 40 has a vertical passageway 44 intersected by a horizontal passageway 46. Vertical passageway 44 opens into a chamber 48. Chamber 48 is adapted to tightly receive the upper end of tube 50. The lower end of tube 50 opens into the interior volume of bottle 10. A gasket 52 insures a tight seal between cap 40 and bottle 10. A nozzle 54 is provided for horizontal passageway 46. Though shown as removable, it should be noted that nozzle 54 could be made integral with cap 40 if desired.

Figure 7:
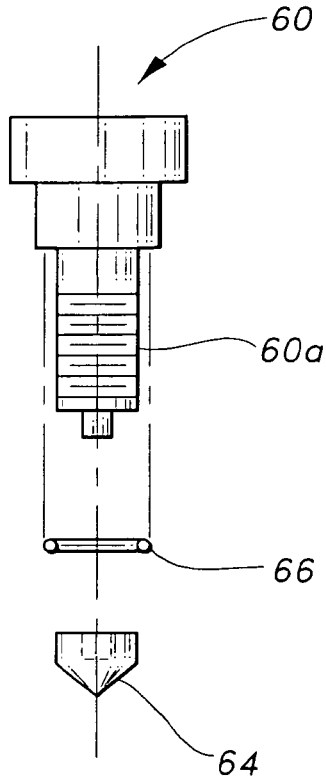
FIG. 7 is a plan view of an alternative needle valve for a second embodiment of a device to retain carbonation according to the present invention.

Vertical passageway 44 has an open proximate end 44*a*. The open distal end of passageway 44 defines a valve seat 44*b*. Passageway 44 is provided with internal threads 44*c* for mating with threads 60*a* on a valve 60. Valve 60 may take on the form of one having a hard seating end 62 (FIG. 6), or the valve may be provided with an elastomeric tip 64 (FIG. 7). The valve 60 is provided with an O-ring 66 to enhance sealing.

The cap and nozzle arrangement shown in the second embodiment allows a carbonated drink to be dispensed simply by opening the valve 60 so that passageway 46 is in fluid communication with tube 50. The pressure of CO2 in the bottle headspace functions to propel the beverage through passageway 46 and nozzle 54. After the beverage is dispensed, the valve is closed to retain carbonation.

It is to be understood that the present invention is not limited to the embodiments described above, but encompasses any and all embodiments within the scope of the following claims.

I claim:

1. A device to retain carbonation, said device consisting essentially of:

a container, said container having an interior volume, a closed bottom and an open top and housing a carbonated beverage;

a cap member, said cap member removably attached to said open top of said container, said cap member including a vertical passageway having an open proximate end and an open distal end, wherein said open distal end forms a valve seat, a chamber disposed adjacent said open distal end, a horizontal passageway opening into said vertical passageway, and screw threads disposed on an internal surface of said cap member for removably attaching said cap member to said container;

a removable nozzle member for dispensing said carbonated beverage from said container, said removable nozzle member attached to said horizontal passageway;

a tube having an open upper end and an open lower end, said open upper end of said tube removably attached to said cap member within said chamber so as to be in fluid communication with said nozzle; and an adjustable valve rotatably disposed in said cap member, wherein said valve is positioned in said vertical passageway and closes said proximate end.

* * * * *